United States Patent [19]

Fujioka et al.

[11] 4,165,612

[45] Aug. 28, 1979

[54] STRUCTURE FOR MOUNTING AN EXHAUST MANIFOLD TO THE BODY OF AN INTERNAL COMBUSTION ENGINE

[75] Inventors: Yasuo Fujioka, Toyota; Kenichi Nakano, Okazaki, both of Japan

[73] Assignee: Toyota Jidosha Kogyo Kabushiki Kaisha, Japan

[21] Appl. No.: 860,165

[22] Filed: Dec. 13, 1977

[30] Foreign Application Priority Data

Sep. 19, 1977 [JP] Japan ..... 52-112441

[51] Int. Cl.[2] ..... F01N 7/10

[52] U.S. Cl. ..... 60/322; 60/323

[58] Field of Search ..... 60/322, 323, 282

[56] References Cited

U.S. PATENT DOCUMENTS

| | | | |
|---|---|---|---|
| 2,858,667 | 11/1958 | Reske | 60/322 |
| 3,470,690 | 10/1969 | Thompson | 60/323 |
| 3,864,908 | 2/1975 | LaHaye | 60/323 |

*Primary Examiner*—Douglas Hart

*Attorney, Agent, or Firm*—Stevens, Davis, Miller & Mosher

[57] ABSTRACT

A structure for mounting an exhaust manifold of the type having a plurality of branch tubular portions and a continuous strip-like flange portion which joins the free end portions of the branch tubular portions to the body of an internal combustion engine, wherein only opposite end portions of the strip-like flange portion are positively fastened to the body of the engine.

3 Claims, 7 Drawing Figures

STRUCTURE FOR MOUNTING AN EXHAUST MANIFOLD TO THE BODY OF AN INTERNAL COMBUSTION ENGINE

BACKGROUND OF THE INVENTION

The present invention relates to a structure for mounting an exhaust manifold to the body of an internal combustion engine and, more particularly, to a mounting structure for an exhaust manifold having a plurality of branch tubular portions and a continuous strip-like flange portion which joins the free end portions of said branch tubular portions.

The exhaust manifold of a multi-cylinder internal combustion engine employed in an automobile is heated up to a relatively high temperature such as 500°-600° C. by hot exhaust gases flowing therethrough during operation of the engine, whereby the exhaust manifold thermally expands to elongate in the lengthwise direction of the multi-cylinder engine as well as to bend relative to the side wall of the body of the engine to which the manifold is mounted, because the flange portion of the manifold is cooled by the cylinder head and is maintained at a moderate temperature, whereas the joining portions of the tubular portions are heated up to a high temperature by exhaust gases. Conventionally, an exhaust manifold, particularly an exhaust manifold for a multi-cylinder engine having a plurality of branch tubular portions and a continuous strip-like flange portion which joins the free end portions of said branch tubular portions, is firmly fastened to a side wall portion of the body of an internal combustion engine by a plurality of mounting bolts arranged substantially uniformly over the entire length of the strip-like flange portion, with the interposition of a gasket sheet means therebetween. In this mounting structure, it is often contemplated to relieve thermal expansion of the manifold in the lengthwise direction of the engine by incorporating a shiftable structure at the bolt mounting portions, such as elongated bolt holes, whereby such lengthwise expansion of the manifold is relatively easily relieved without causing any leakage clearance between the exhaust manifold and the body of the engine. However, with regard to the aforementioned bending of the exhaust manifold, no means has yet been proposed which can effectively relieve such a bending without causing any leakage clearance between the exhaust manifold and the body of the engine. Therefore, in the conventional structure for mounting an exhaust manifold, particularly a manifold for a multi-cylinder engine having a strip-like flange portion, to the body of an internal combustion engine, the strip-like flange portion is firmly fastened over its entire length by a number of mounting bolts so as forcibly to suppress the bending of the exhaust manifold thereby maintaining the flange portion of the manifold substantially in contact with the cooperating side wall portion of the body of the engine over the entire region thereof even in the hot operating condition. However, when the thermal bending of the exhaust manifold is restricted in the abovementioned manner, the central portion between the opposite ends of the manifold is compressed under high thermal stressing during hot operation and undergoes plastic deformation (compression), whereby the shape of the exhaust manifold in its normal unheated condition becomes inversely bent and begins to form a large leakage clearance, particularly in relatively cold operation. If the clamping force of the mounting bolts is increased over the entire region of the flange portion in order to avoid any leakage clearance being formed, the exhaust manifold is subject to heavy thermal stressing and will undergo thermal cracking.

SUMMARY OF THE INVENTION

The primary object of the present invention is to provide an improved structure for mounting an exhaust manifold to the body of an internal combustion engine wherein the formation of leakage clearance between the manifold and the body of the engine is substantially reduced without causing any heavy stressing in the manifold.

In order to accomplish such an object, the inventors have contemplated two aspects of the aforementioned bending of an exhaust manifold, particularly of one having a plurality of branch tubular portions and a continuous strip-like flange portion which joins the free end portions of said branch tubular portions. If the flange portion of the manifold is firmly fastened at its central portion to the body of the engine, the manifold will be plastically bent so as to be convex against the cooperating side wall portion of the body of the engine after a period of operation, due to the aforementioned thermal stressing in hot operation. On the other hand, if the flange portion of the exhaust manifold is firmly fastened only at its opposite end portions to the body of the engine, the aforementioned thermal stressing which causes the aforementioned inverse bending of the manifold is partly relieved while on the other hand the central portion of the manifold is subject to a force due to its thermal expansion which will bend the manifold so as to be concave against the corresponding wall portion of the body of the engine, i.e. in the opposite bending direction when compared with the aforementioned plastic bending caused by the thermal stressing. Therefore, it is to be noted that by judiciously fastening opposite end portions of the flange portion of an elongated exhaust manifold to the body of an engine, the aforementioned two bending actions in opposite directions are cancelled by each other and an improved mounting of the exhaust manifold is accomplished with regard to the formation of leakage clearance as well as to the thermal stressing of the manifold.

Therefore, in accordance with the present invention, the abovementioned object is accomplished by providing a structure for mounting an exhaust manifold to the body of an internal combustion engine, said manifold having a plurality of branch tubular portions and a continuous strip-like flange portion which joins the free end portions of said branch tubular portions, wherein mounting bolts are provided so as to fasten only opposite end portions of said strip-like flange portion to the body of the engine.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
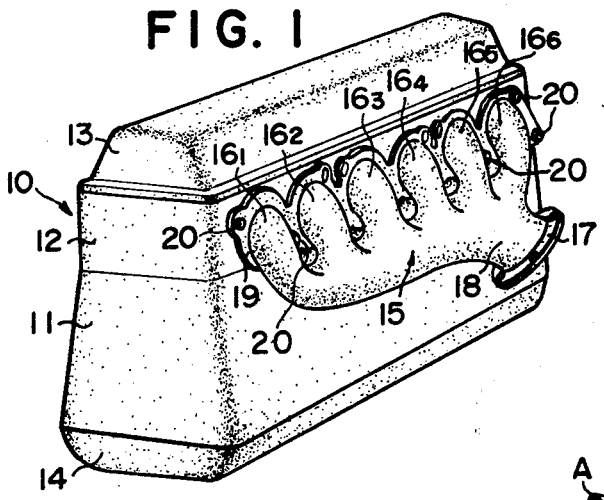
FIG. 1 is a somewhat diagrammatical perspective view of an assembly of the body of an internal combustion engine and an exhaust manifold wherein the mounting structure for the exhaust manifold according to the present invention is incorporated.

Referring to FIG. 1, 10 designates an internal combustion engine having its body assembled from a cylinder block 11, a cylinder head 12, a cylinder head cover 13, and an oil pan 14. The engine is constructed as a six-cylinder engine and, corresponding to this, an exhaust manifold 15 having six branch tubular portions $16_1$-$16_6$ is mounted to the body of the engine. The six branch tubular portions join together and lead into a common tubular portion 18 having a connection flange 17 for connection with an exhaust pipe not shown in the figure. On the other hand, the free end portions of the six branch tubular portions are joined together by a continuous strip-like flange portion 19. In fact, therefore, the exhaust manifold 15 is mounted to the body of the engine by the flange portion 19 being fastened to a side wall portion of the cylinder head 12 by a plurality of mounting bolts 20.

Figure 3:
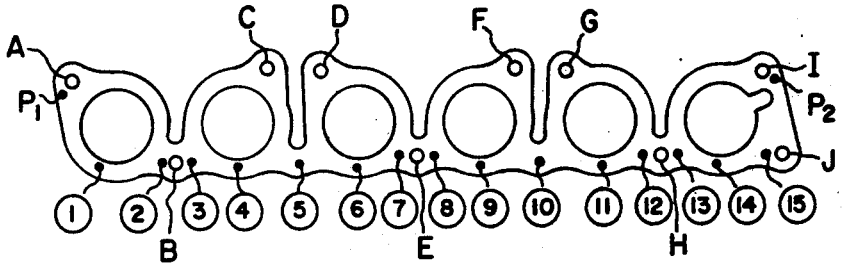
FIG. 3 is a diagrammatical view showing the contour of the flange portion of the exhaust manifold shown in FIG. 2 illustrating various measuring points.

In the embodiment shown in FIG. 1, the exhaust manifold 15 has a number of bolt holes arranged along the entire length of the strip-like flange portion 19, as best shown in FIG. 3, in accordance with the conventional mounting structure wherein the strip-like flange portion is fastened to the body of the engine substantially uniformly over its entire length. However, in accordance with the mounting structure of the present invention, the mounting bolts 20 are only applied to the bolt holes corresponding to the branch tubular portions $16_1$, $16_2$, $16_5$, and $16_6$, i.e. to opposite end portions of the strip-like flange portion 19.

In order to investigate the performance of the mounting structure in accordance with the concept of the present invention, the inventors have carried out various experiments, from which some typical results have been extracted and are explained hereinunder.

Figure 2:
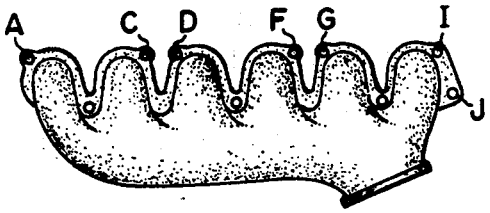
FIG. 2 is a side view of the exhaust manifold included in the assembly shown in FIG. 1.

The exhaust manifold which provided the following results had the structure shown in FIGS. 1-3 and was entirely made of granular graphite cast iron FCD 40 (JISG 5502). As shown in FIG. 3, the exhaust manifold had ten bolt holes A-J as in the conventional structure for the purpose of comparison of performance between the conventional mounting structure and that of the present invention. As an experimental schedule, the engine was self-operated by combustion of fuel (firing) at 4000 RPM for ten minutes and thereafter the engine was driven by an external motor (motoring) at 3500 RPM for five minutes. This process was designated as "one heating cycle," and various numbers of heating cycles were performed in various experiments.

Figure 4:
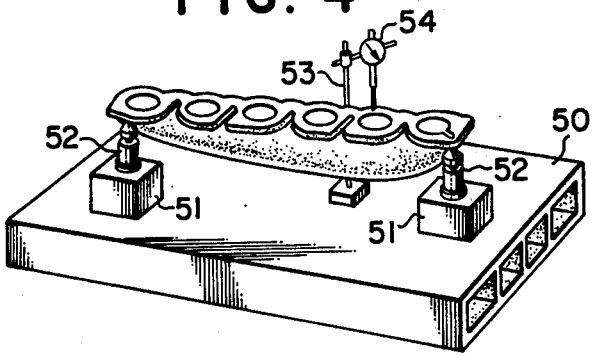
FIG. 4 is a perspective view showing the manner of measuring deformation of the flange face of the exhaust manifold.

Deformation of the flange face, i.e. of the face of the flange portion 19, was measured in the manner shown in FIG. 4, wherein the exhaust manifold was disassembled from the body of the engine and was laid on a base plate 50 by supporting means such as blocks 51 and micro-jacks 52 so as to present the flange face upwards. The measurement was made by a dial gauge 54 supported by a stand post 53. Measurement of deformation was made at points (1)-(15) shown in FIG. 3. During measurement, the exhaust manifold was supported at points $P_1$, $P_2$ and (14).

Figure 5:
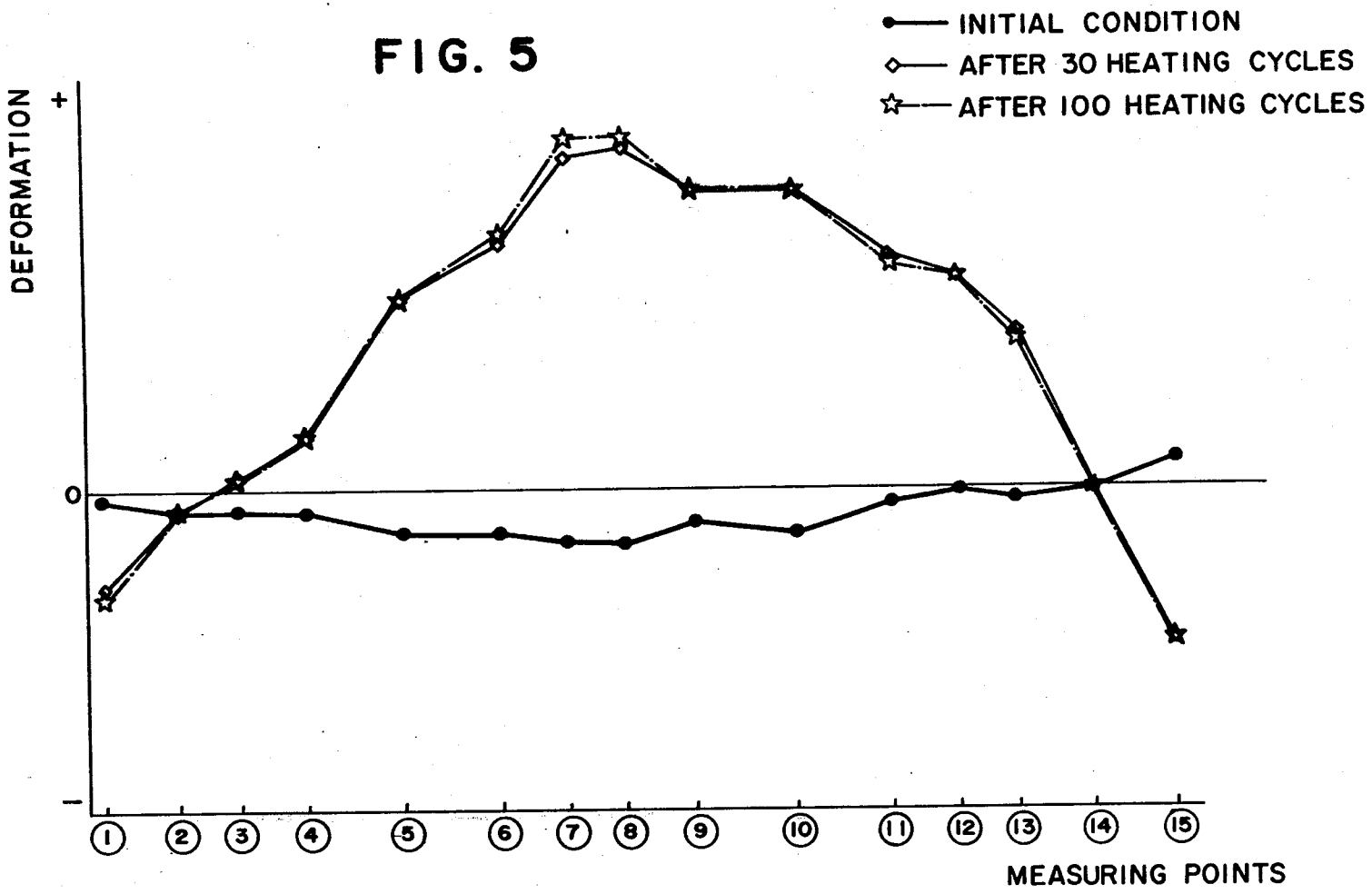
FIG. 5 is a graph showing deformation of the flange face of the exhaust manifold shown in FIGS. 1-3 mounted in accordance with the conventional mounting structure.

FIG. 5 shows the performance of the conventional mounting structure wherein mounting bolts are applied to all bolt holes A-J so as to fasten the flange portion 19 over the entire length thereof. The results are shown by the deformation at points (1)-(15) in the initial condition (before operation of heating cycles), after thirty heating cycles, and after a hundred heating cycles. In the graph, positive deformation means deformation so as to close up to the mounting face of the body of the engine, whereas negative deformation means deformation to move away from the mounting face. From FIG. 5 it will be understood that the flange face of the exhaust manifold is plastically deformed to become convex against the mounting face of the body of the engine.

Figure 6:
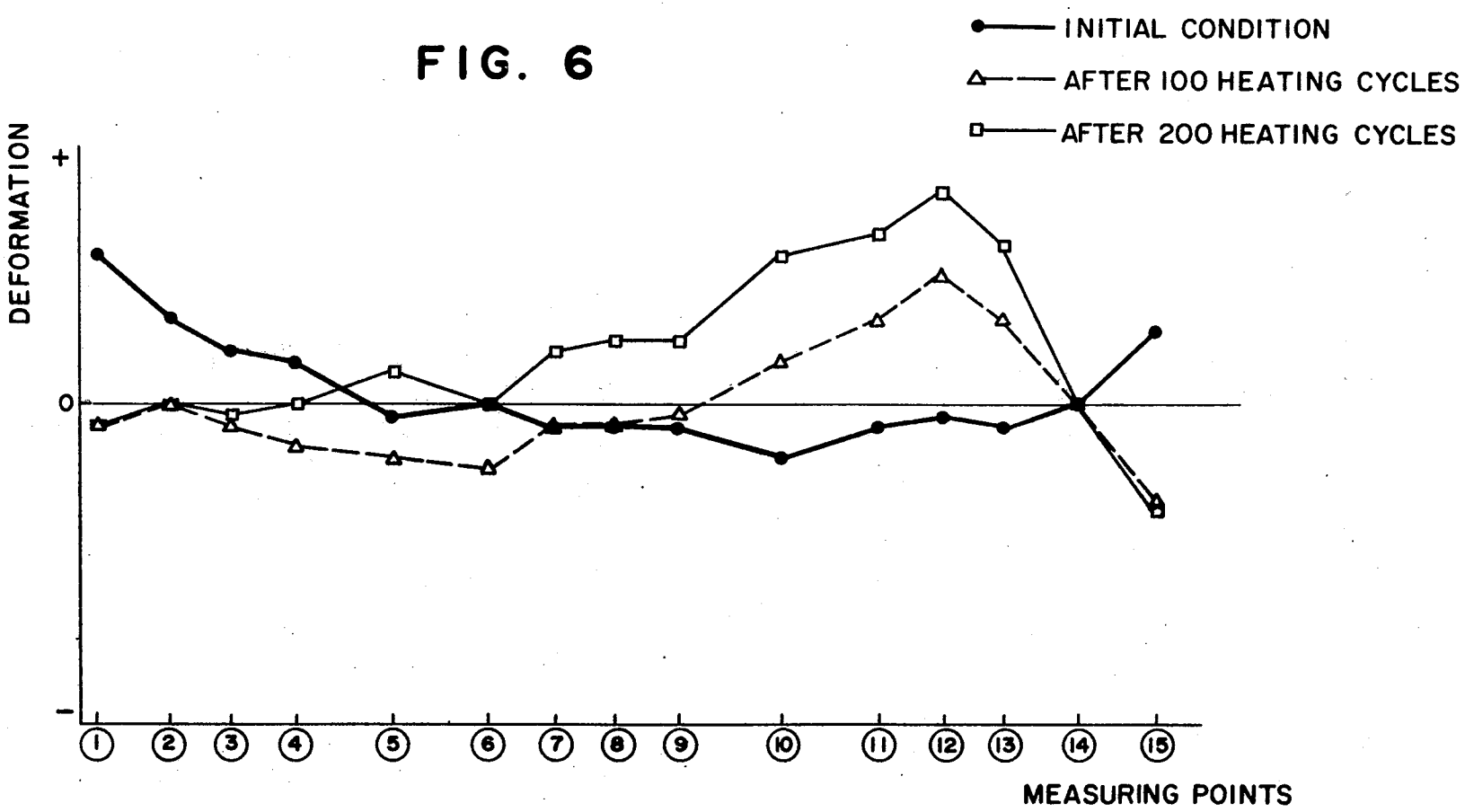
FIG. 6 is a graph showing deformation of the flange face of the exhaust manifold shown in FIGS. 1-3 mounted in accordance with the mounting structure of the present invention.

FIG. 6 shows the performance of the mounting structure of the present invention in a similar manner as in FIG. 5. In this case, an exhaust manifold having the same structure as used in the experiment shown in FIG. 5 was first mounted by applying mounting bolts only to bolt holes A, B, H, I, and J until one hundred heating cycles were finished. Thereafter, mounting bolts were also applied to bolt holes C and G. The results in FIG. 6 are shown to the same scale as those in FIG. 5. By comparing FIG. 6 with FIG. 5, it will be appreciated that the deformation caused in the flange face of the exhaust manifold after a substantial period of operation is very much reduced in the case of the mounting structure of the present invention when compared with that of the conventional mounting structure. In accordance with this reduction in the deformation of the flange face of the exhaust manifold, lesser leakage clearances are maintained during the operation of the engine, particularly during cold starting-up operation of the engine.

Conventionally, in view of the danger of thermal cracking due to high thermal stressing of the exhaust manifold in operation, exhaust manifolds are often manufactured by employing granular graphite cast iron. However, when the present invention is employed, thermal stressing is very much reduced, whereby grey cast iron can be more safely used. Thus, the present invention provides also the advantage that the manufacturing cost of exhaust manifolds is substantially lowered.

Figure 7:
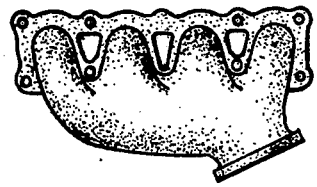
FIG. 7 is a side view of another example of an exhaust manifold which can be advantageously mounted to the body of an engine by the mounting structure of the present invention.

The present invention is effective for the mounting of an exhaust manifold having a plurality of branch tubular portions and a continuous strip-like flange portion which joins the free end portions of said branch tubular portions, and is more effective when the branch tubular portions are relatively short and the exhaust manifold has a relatively rigid structure as a whole. FIG. 7 shows another example of an exhaust manifold to which the present invention can be effectively applied. In this exhaust manifold, no bolt hole is provided at all at the central portion of its flange portion. From the results of various experiments performed by the inventors, it has been concluded that in the case of an exhaust manifold having six branch tubular portions, such as shown in FIGS. 1–3, it is generally desirable that positive fastening of the flange portion to the body of an engine by mounting bolts is applied over the two regions at opposite ends of the manifold, each of which corresponds to two branch tubular portions, i.e. to branch tubular portions $16_1$, $16_2$, $16_5$, and $16_6$ in the embodiment shown in FIG. 1, and that, in the case of an exhaust manifold having four branch tubular portions such as shown in FIG. 7, it is generally desirable that positive fastening is applied over the regions at opposite ends of the manifold each of which corresponds to one branch tubular portion, as in the embodiment shown in FIG. 7, wherein bolt holes are provided so as to clamp the free end portions of the flange corresponding to the two opposite end branch tubular portions.

As an obvious modification of the present invention, the exhaust manifold may have bolt holes arranged over the entire length of its strip-like flange portion as in the conventional mounting structure, wherein the central portion of the flange portion may also be clamped by mounting bolts by way of spring means which have a low spring constant and are soft enough not to apply any substantial restriction to the thermal deformation of the central portion of the flange portion.

Although the invention has been shown and described with respect to some preferred embodiments thereof, it should be understood by those skilled in the art that various changes and omissions of the form and detail thereof may be made therein without departing from the scope of the invention.

We claim:

1. A structure for mounting an exhaust manifold to the body of an internal combustion engine, said manifold having a plurality of branch tubular portions and a continuous strip-like flange portion which joins the free end portions of said branch tubular portions, wherein mounting bolts are provided so as to fasten only opposite end portions of said strip-like flange portion to the body of the engine.

2. The structure of claim 1, wherein said manifold has six branch tubular portions and said flange portion is fastened to the body of the engine by said mounting bolts at opposite end portions each of which corresponds to the two branch tubular portions at one end of the manifold.

3. The structure of claim 1, wherein said manifold has four branch tubular portions and said flange portion is fastened to the body of the engine by said bolts at opposite end portions each of which corresponds to one branch tubular portion at one end of the manifold.

* * * * *